United States Patent [19]

Dougher et al.

[11] Patent Number: 4,692,952

[45] Date of Patent: Sep. 15, 1987

[54] SLATTED SOFA-BED CONSTRUCTION

[76] Inventors: Christine A. Dougher, 3908 Shenandoah, St. Louis, Mo. 63110; Mary L. Rath, Rte. 1, Belle, Mo. 65013

[21] Appl. No.: 797,009

[22] Filed: Nov. 12, 1985

[51] Int. Cl.[4] ..... A47C 17/04

[52] U.S. Cl. ..... 5/37 R; 5/12 R; 5/51 B; 5/236 R

[58] Field of Search ..... 5/12 R, 37 R, 37 C, 5/37 B, 51 B, 2 R, 59 R, 400, 236 R, 191

[56] References Cited

U.S. PATENT DOCUMENTS 4,402,096 9/1983 Atimichuk ..... 5/37 C

OTHER PUBLICATIONS

"Furniture Gallery", ad in the Voice Newspaper, N.Y.C., 8/20/85 issue.

*Primary Examiner*—Alexander Grosz

*Attorney, Agent, or Firm*—Jerome A. Gross

[57] ABSTRACT

A wood slatted sofa-bed requires no mechanism. Slanting slots are provided in side edge rails of the seat section, starting spaced away from its head rail, to receive the lowermost back section cross-slats. When the back section is raised and its lowermost slat is inserted in these slots, back section side rail supports, located out of correspondence with the side rails of the seat section, extend backward to and rest on the seat section head rail. For the bed configuration, the same back section rail supports hold the back section at the level of the seat section. Skids on the seat section facilitate moving it away from a wall, to provide space for the back section when so lowered to bed configuration.

6 Claims, 8 Drawing Figures

FIG. 5
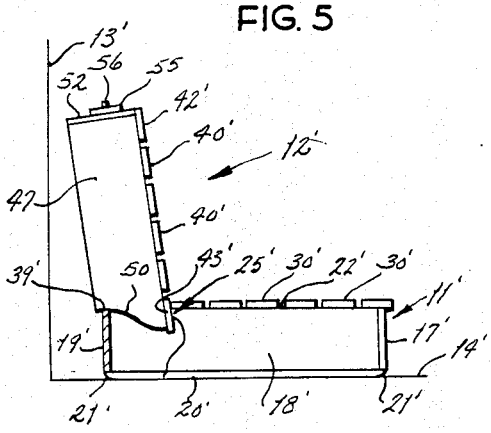
FIG. 8
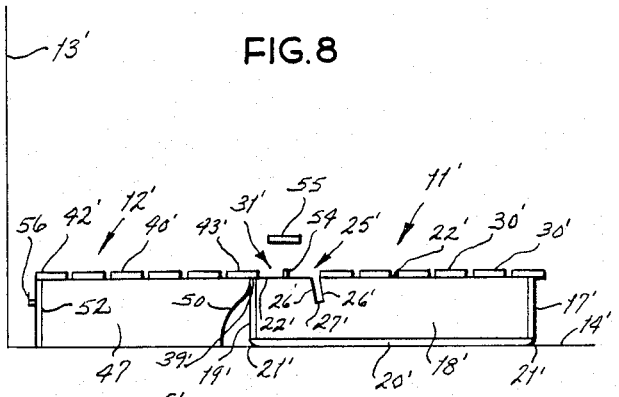
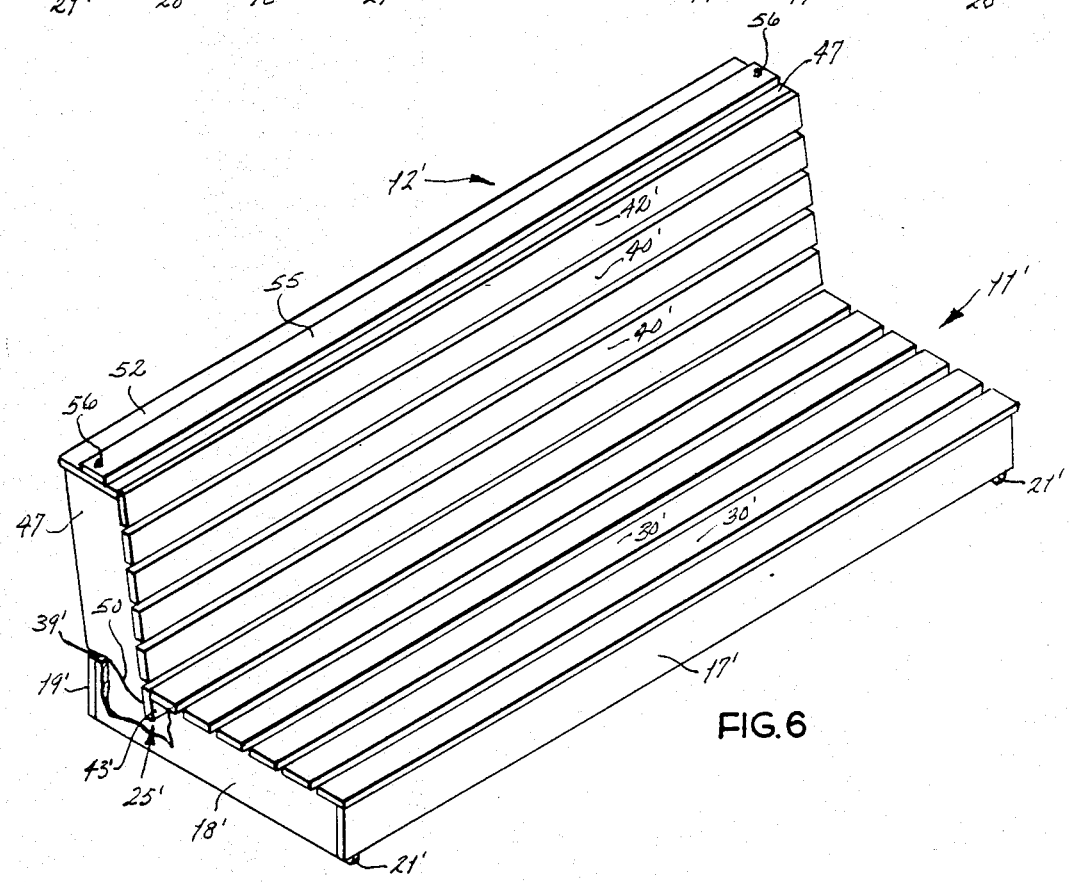
FIG. 6
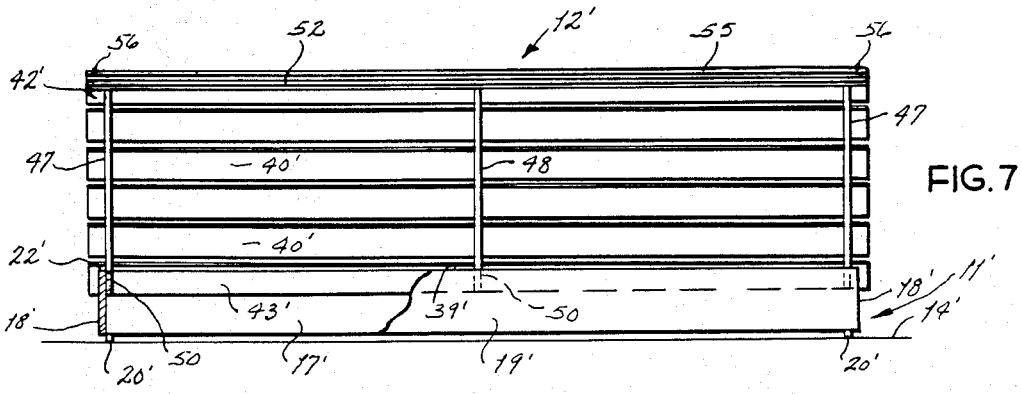
FIG. 7

SLATTED SOFA-BED CONSTRUCTION

BACKGROUND OF THE INVENTION

This invention relates to sofa-bed construction which requires no mechanism; and more specifically to sofa-bed construction consisting of a seat section and a back section, preferably of wood cross-slatted construction, for use either as a sofa or a bed. A removable futon, or heavy conformable mattress pad, serves alternately as the sofa upholstery and the bed mattress.

SUMMARY OF THE INVENTION

An object of this invention is to provide a sofa-bed construction with no mechanism whatsoever. In the present invention, this is accomplished generally, by leaving a portion of the seat section unslatted from its head rail to a pair of slanting slots in the upper edges of its side rails, the slots being of sufficient width to accommodate the lowermost slat of a back section. The unslatted portion provides an opening, adjacent to the seat section head rail, for the downward ends of the back section side rails; being spaced out of correspondence with the side rails of the seat section, they interfit with the seat section rails when the back section is erected. In this position their support portions project aft, to rest upon and against the seat section head rail.

Two embodiments of invention are here shown. The first of these relies in part, for bed length, on a coffee table of similar height, which the seat section contacts when moved, on skids, away from the wall; the back section is then lifted from the slots, reversed (so its formerly top slat will extend over the head rail of the seat section) and lowered into position. The other embodiment illustrated does not require any coffee table or other supplementary structure; instead it utilizes for bed length the full width of both the seat and back sections. This embodiment requires a supplementary slat or slats to be placed upon the seat section side rails between their slanting slots and the head rail, to cover the opening which is adjacent to the seat section head rail.

BRIEF DESCRIPTION OF THE DRAWINGS

FIG. 5 is a view generally similar to FIG. 1 of an alternate embodiment of the present invention, positioned to serve as a sofa.

FIG. 6 is an isometric view thereof, partly broken away.

FIG. 7 is a rear view thereof, partly broken away.

FIG. 8 is a view thereof showing the seat section slid away from a wall and the back section in course of being lowered adjacent the head rail of the section, to serve as a bed. A supplementary slat is shown in exploded position, prior to being placed downward on the seat section.

DESCRIPTION OF THE PREFERRED EMBODIMENTS

In the preferred embodiment of the invention shown in FIGS. 1–4 inclusive, the combined sofa bed construction is to be used in connection with a coffee table 10 of similar height and width, not part of the present invention and therefore shown in phantom. For clarity of illustration, the trim strips 32, 41 are not shown in FIGS. 1 and 4.

Figure 1:
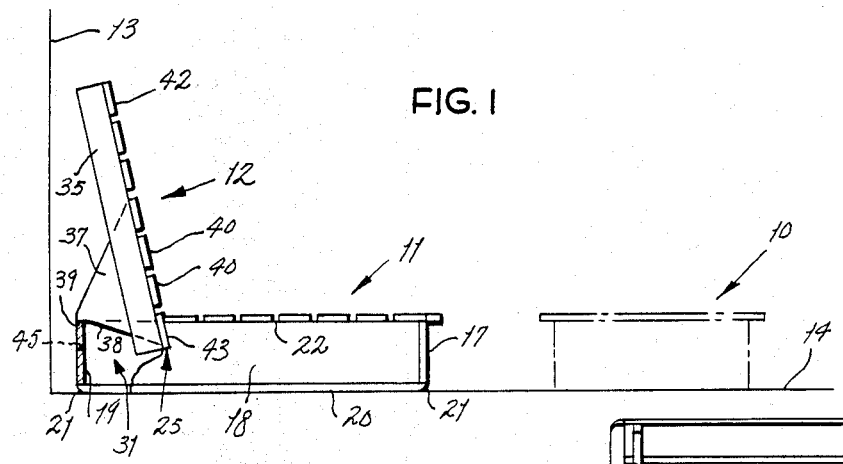
FIG. 1 is a left end view, partly schematic and broken away, of a sofa bed according to a preferred embodiment of the present invention, shown with its back section erected to serve as a sofa adjacent to a wall. A supplementary coffee table, not part of the present invention, is shown in phantom.

The present new construction comprises a seat section generally designated 11 and a back section generally designated 12, with the seat section 11 shown in FIG. 1 positioned on a floor 14 in sofa configuration, close to a room wall 13. The combination is intended to be used with a conventional futon, or flexible conforming mattress pad, which serves both as the upholstery when the combination is utilized as a sofa in the FIG. 1 position, and as a mattress when used as a bed, as in FIG. 4.

The styling of this embodiment, as well as the embodiment shown in FIGS. 5–8, is consistent with Japanese or modern furnishings. It is preferably of sturdy wooden construction. Thus, the seat section 11 includes a foot portion defined by an upstanding foot rail 17 and side rails 18 joined at 90° angles thereto; their other ends are joined to a similar upstanding head rail 19. While these members are preferably all the same depth, the side rails 18 have, secured to their undersides, shallow longitudinal skids 20 whose upward curved ends 21 permit easy longitudinal sliding toward and away from the wall 13. The skids 20 provide clearance above the floor 14 for the lower portions of the foot rail 17 and head rail 19.

Figure 4:
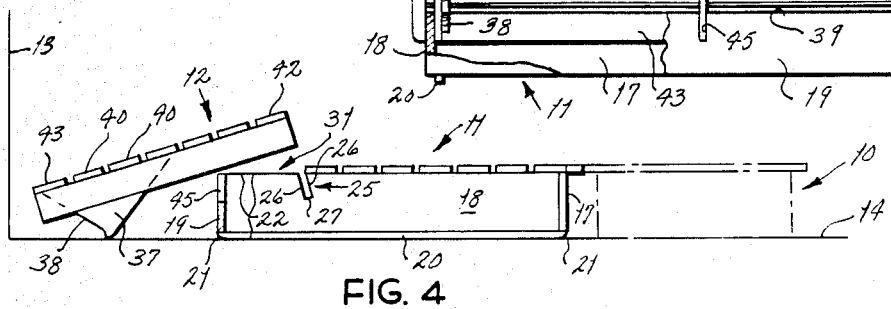
FIG. 4 shows the assembly similarly to FIG. 1, with the seat section slid away from the wall and with the back section reversed in position and being lowered to overlap the head rail of the seat section, to serve as a bed.

In the upper edge 22 of each of the side rails 18, at a position spaced from the head rail 19 a distance generally substantially equal to the depth of the side rails (or to their depth combined with that of the skids 20), is provided a slot generally designated 25, best seen in FIG. 4, having parallel forward and rear slot surfaces 26 slanting toward the foot rail 17 and downward from the side rail upper edges 22. The frame opening generally designated 31 which is left between these slats 30 and the head rail 19, is put to use, as later described. Each slot 25 terminates downwardly in a slot base 27 at about mid-height of the side rail 18, or at least substantially above its lower edge. The width of the slots 27 is sufficient to accommodate slidingly the back slats 40, or in any event the lowermost slat 43 of the back section 12.

Secured across the upper edges 22 of the side rails 18, and extending over the area from the slanting slots 25 to the foot rail 17, are a plurality of seat section cross slats 30, of heavy wooden construction so that they may bear, without undue deflection, the weight imposed either as a sofa or a bed. While these rails are the only support means shown in the drawings for such cross slats, conventional reinforcing structure may be provided. The ends of the cross slats 30 may optionally be finished off by lateral end trim strips 32 shown in FIGS. 2 and 3 at each side edge of the seat section slats 30. The trim strips 32 may be any desired width; for example, they may be broad enough to cover, in whole or in part, the upper edges 22 of the side rails 18 from the slots 25 to the foot rail 17.

Figure 3:
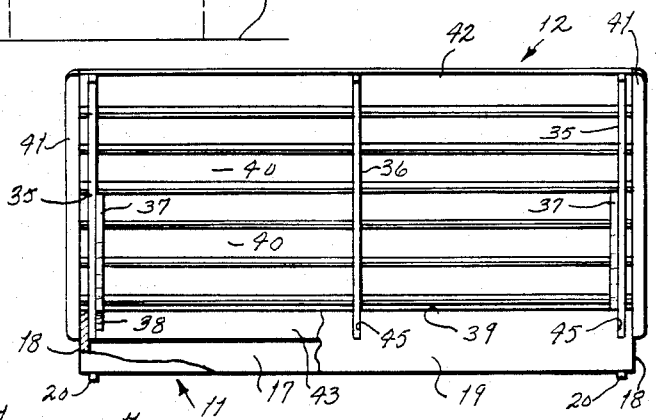
FIG. 3 is a rear view, partly broken away, of said sofa bed.
Figure 2:
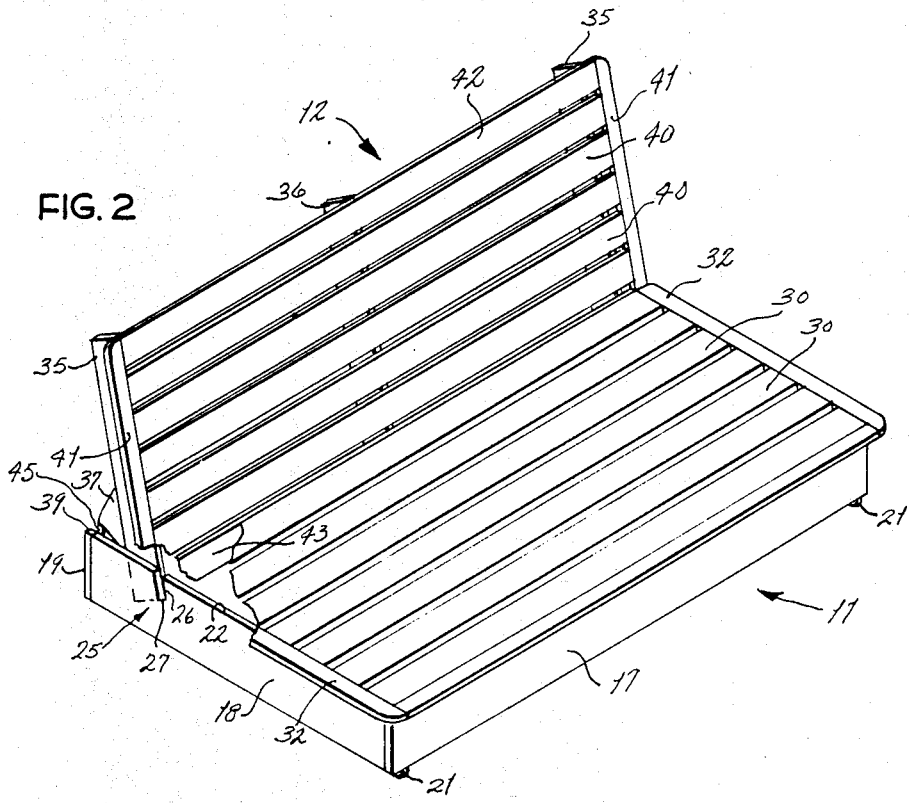
FIG. 2 is an isometric view, partly broken away, of the sofa bed of FIG. 1.

The back section 12 will now be described. It includes a pair of left and right back rails 35 and preferably an intermediate back rail 36. These back rails 35 are so spaced from each other as to be out of correspondence with the spacing of the side rails 18, as seen in FIGS. 2 and 3. In this illustrated embodiment, their spacing is less than that of the seat section rails 18, so that when the back section is erected as shown in FIGS. 1 and 2, it will extend into the seat section frame opening 31; and the lower ends of the back rails 35 will be positioned inwardly of but adjacent to the side rails 18.

The back section rails 35 have, securedly mounted to them, the somewhat triangular rigid support members 37 seen in FIGS. 1, 2 and 4. Their shape is chosen to be convenient to serve the functions hereinafter described.

Spanning the left and right back rails 35 are back slats 40 preferably of the same length, width and thickness as the seat section slats 30. In the embodiment shown the ends of the back slats 40 are trimmed by trim strips 41 (not shown on FIGS. 1 and 4) corresponding in their width and thickness to the seat section trim strips 32. As with the seat section 11, the trim strips 41 of the back section 12 are optional.

Of the back slats 40, of particular interest is the top slat 42 and the lowermost position slat 43, both of them being so named to reflect their positions when the combination is in the sofa configuration. As seen, the end portions of the lowermost slat 43 fits slidably within the slanting slots 25 of the seat section 11. However, if the trim strips 41 were made broader, as is optional, portions of the trim strips 41 at the ends of the lowermost slat 43 may be within said slots 25. In the claims, references to end portions of the lowermost position slat 43 are to be taken to include such trim strip portions.

Referring again to the back section support members 37, their characteristics will be best understood by contrasting FIG. 1 with FIG. 4. In FIG. 4 the seat section 11 has been slid away from the wall on its longitudinal skids 20, and the back section has been reversed from the position shown in FIG. 1. As so reversed, its lowermost position slat 43, as above defined, is nearest to the wall 13 and its top position slat 42, as above defined, overlies the seat section side rails 18 from its head rail 19 to its diagonal slots 25. Since the chosen spacing of the left and right back rails 35 is closer than the spacing of the seat section side rails 18, the back section side rails 35, as well as the intermediate back rail 36, are accommodated, in the FIG. 4 position, by extending through slots 45, only slightly wider than such back rails, in the upper edge 39 of the seat section head rail 19, as seen in FIG. 3. Note that the somewhat triangular support members 37 are not integral with, or aligned with, the back section side rails 35, but are secured alongside these rails. Hence the support members 37 support the back section 12 by resting upon portions of the upper edge 39 of the seat section head rail 19 adjacent to these slots 45.

Since the somewhat triangular support members 37, which serve as support means for the back section rails 35, must not, in the "bed" configuration, interfere with the head rail 19, they are limited in length, so as to terminate (as shown in FIG. 4) remote from the top slat 42. Specifically, they must not interfere with the space from the seat section head rail 19 to the slanting slots 25. When the back section 12 is fully lowered to the bed configuration, the back section rails extend through the head rail slots 45 and the back slats 40 are flush with the plane of the upper surface of the seat section slats 30. As seen, the back section support means 37 have a depth, measured from the back slats 40, substantially equal to the combined depth of the seat section side rails 18 and their longitudinal skids 20. Finally, to support the back section 12 in the sofa configuration, each said support means 37 has an edge 38 which, as seen in FIG. 4, is offset inwardly from the lowermost slat 43 so that, in the sofa utilization of FIG. 1, the edge 38 projects aft and upward, relative to the slot base 27, and rests upon and against the upper edge 39 of the seat section head rail 19 adjacent to one of the rail slots 45.

Since the back section 12 rests in and on the seat section 11 without attachment or mechanism, an explanation is in order as to the manner in which it resists loads applied against and perpendicular to the back section 12. Assuming that such loads, applied by persons leaning against the back section 12, are substantially centered at its midheight, the force they apply, perpendicular to the plane of the back slats 41, will be transferred in part as downward and aft force components applied by the support member edges 38 onto the upper edge 39 of the seat section head rail 19. Force transference below the point of force application would impart a tendency to rotate, which must be reacted still lower, in this case, by force components exerted by the lowermost position slat 34 against the forward surfaces 26 of the slanting slots 25.

Referring to FIGS. 5–8, an alternate embodiment is shown which is in many respects similar to the embodiment of FIGS. 1–4, no seat and back section trim strips 32, 41 being provided. A principal difference in proportion is that, unlike the FIGS. 1–4 embodiment (which utilizes the width of a coffee table 10 as part of the total bed length), the embodiment of FIGS. 5–8 utilizes seat and back units whose width as a sofa is sufficient to provide the bed length. Bed width is provided by placing the seat and back units edge to edge, without reversing the back section and without the back section overlap; contrast FIG. 8 with FIG. 4.

To avoid duplication of wording in referring to FIGS. 5–8, parts corresponding in substance to those of FIGS. 1–4, though different in proportion, are designated with the same numerals but with a "prime" superscript; hence no detailed description is repeated of such parts, it being understood that the previous descriptions of such corresponding parts will be applicable.

Instead of the back section support means 37 utilized in the FIGS. 1–4 embodiment, and the relatively shallow back rails 35, 36 of that embodiment, the embodiment of FIGS. 5–8 utilizes deep back section side rails 47, extending the full combined depth of the seat section side rails 18' and the longitudinal skids 20'. If desired, an intermediate support rail 48, similar to these back section side rails 47, may be utilized for further support.

The lowermost edges 50 of these back section side rails 47 (that is, the edges which are lowermost when the back section is erected in sofa position, shown in FIGS. 5, 6 and 7) serve as integral support means for the back section 12'. Like the edges 38 of the support members 37 of the FIG. 1–4 embodiment, they are offset inwardly from the lowermost slat 43' of the back section sufficiently so that, when in position shown in FIGS. 5 and 6, the edges 50 will project aft and upward relative to the slot bases 27', and portions of the edges 50 will rest upon and against the upper edge 39' of the head rail 19'. The preferred manner of effecting such inward offset from the lowermost slat 43' is seen in FIG. 8, showing the seat section 11', slid on its skids 20' from the wall 13', and the back section 12' interposed. If a back section center rail 48 is also used, it will preferably have a similar lower edge 50, which likewise rests on the upper edge 39' of the seat section head rail 19' when in the sofa configuration.

The back section 12' may have other conventional reinforcements, such as the full depth upper edge rail 52, illustrated as joining the side rails 47.

Referring to FIG. 8, the opening 31' between the seat section diagonal slots 25' and its head rail 19', would be left exposed, as shown in FIG. 8, were not some supplementary provision made to span the opening. For this purpose, wood pins 54 project vertically from the upper edges 22' of the side rails 18' to a height approximately equal that of the slats 30'; and a supplementary slat 55, shown in upwardexploded position in FIG. 8, is provided, drilled to fit onto the pins 54. When the supplementary slat 55 is mounted on the pins 54, it leaves no greater openings than are provided between the other slats 30'. In the sofa configuration, FIG. 5, the supplementary slat 55 is conveniently stored on similar wooden pins 56 which project from the upper edge rail 52.

From this description various modifications will occur to those desiring to effect the mechanism-free advantages of the present invention. For example, the head rail of the seat section may be extended to project slightly outward of the side rails, and the back section side rails supported from such extensions. The term "out of correspondence with" the side rails is not therefore to be limited to the constructions shown. If desired, no openings need be left between the cross-slats; or uninterrupted sheets of material such as plywood may be substituted for the cross-slats. While the term "slats" is employed in the claims, this term is to be understood as including the corresponding edges or other portions of such analogous solid construction. Note also that the coffee table 10, shown in phantom for use with the first embodiment described, would be rendered unnecessary by a mere change of proportions of the seat and back units 11, 12, and hence is not an element of this invention.

We claim:

1. Cross-slatted sofa bed construction comprising a seat section including a foot portion, a head rail opposite said foot portion, vertically-extending side rails securing said head rail to said foot portion, said side rails having longitudinal skid means along their lower edges, whereby to permit sliding movement of said seat section along a floor, and a slot into the upper edge of each said side rail extending slantingly toward the foot portion and downward from the side rail upper edge and having forward and rear slot surfaces terminating in a slot base substantially above the lower edge of said side rails, the said slots being positioned spacedly from the head rail a distance substantially equal to the depth of said side rails, said side rails having cross-slats affixed to their upper edges over only that area extending from said foot portion to said slots, whereby to provide an opening from said slots to the head rail, in combination with a back section comprising left and right back rails so spaced from each other as to be out of correspondence with the spacing of said rails of said seat section, further comprising a plurality of back cross slats extending across said back rails from a top back slat to a slat in lowermost position when the back section is erected, the end portions of said lowermost position slat being of such thickness as to fit slidably within said slanting slots and be there supported with the lowermost edges thereof resting on said slot bases, the said back section left and right rails having support means, adjacent to said lowermost position slat, whose depth, measured from said slat, is substantially equal the combined depth of said seat section side rails and their said skid means, whereby said back section may be erected to serve as a sofa back with its top slat adjacent to a wall, with the end portions of said lowermost position back slat inserted within said diagonal slots and resting on said slot bases, and with the said support means for said back rails projecting into said opening and resting on and against said seat section head rail; or alternatively, on sliding said seat section on its skid means to provide space for the back section between the seat section and such wall, said back section may be supported horizontally with said support means of its left and right rails resting on such floor, for use of the combination as a bed.

2. Sofa bed construction as defined in claim 1, wherein said seat section head rail extends upward to substantially the same level as the said side rail upper edge, and the said support means of the back section rails has an edge which is offset inwardly away from the lowermost slat of said back section, whereby when it is erected to serve as a back section, said support means will so project aft and upward relative to said slot bases, as to rest upon and against the head rail of the seat section.

3. Sofa bed construction as defined in claim 2, in which said support means of the back section rails terminate remote from said top back slat a distance at least equal to that from the seat section head rail to the said slanting slots, whereby, when said back section is lifted from said diagonal slots and its position relative to the seat section is so reversed that said lowermost position slat is remote from said seat section slanting slots, said back rail support means may rest on such floor spacedly away from said seat section while the back section rails and seat section side rails are so interposed that said uppermost back slot rests on the upper edges of said seat section side rails, substantially filling such opening between their said slanting slots and the head rail of said seat section.

4. Sofa bed construction as defined in claim 2, together with said back section support means of the back section rails extend to their full depth adjacent to said uppermost back slat, and a supplementary slat and means to position said supplementary slat removably across said side rails in the area of said opening of the seat section between said edge rail slanting slots and said head rail, whereby when the seat section has been so slid further from such wall and when said back section has been lifted out of said diagonal slots, and supported upon such floor with said support means on such floor and with said lowermost slat adjacent to the seat section head rail, the space between said seat section head rail and diagonal slots in its side rail upper edge may be filled in part by resting said supplementary slat thereacross.

5. Sofa bed construction as defined in claim 1, in which said support means of the back section rails terminate remote from said top back slat a distance at least equal to that from the seat section head rail to the said slanting slots, whereby, when said back section is lifted from said diagonal slots and its position relative to the seat section is so reversed that said lowermost position slat is remote from said seat section slanting slots, said back rail support means may rest on such floor spacedly away from said seat section while the back section rails and seat section side rails are so interposed that said uppermost back slot rests on the upper edges of said seat section side rails, substantially filling such opening between their said slanting slots and the head rail of said seat section.

6. Sofa bed construction as defined in claim 1, together with said back section support means of the back section rails extend to their full depth adjacent to said uppermost back slat, and a supplementary slat and means to position said supplementary slat removably across said side rails in the area of said opening of the seat section between said edge rail slanting slots and said head rail, whereby when the seat section has been so slid further from such wall and when said back section has been lifted out of said diagonal slots, and supported upon such floor with said support means on such floor and with said lowermost slat adjacent to the seat section head rail, the space between said seat section head rail and diagonal slots in its side rail upper edge may be filled in part by resting said supplementary slat thereacross.

* * * * *